US009097484B2

(12) United States Patent
Poirier

(10) Patent No.: US 9,097,484 B2
(45) Date of Patent: Aug. 4, 2015

(54) TOY LAUNCH APPARATUS WITH SAFETY LATCHES

(71) Applicant: Hasbro, Inc., Pawtucket, RI (US)

(72) Inventor: Mark A Poirier, Hubbardston, MA (US)

(73) Assignee: Hasbro, Inc., Pawtucket, RI (US)

( * ) Notice: Subject to any disclaimer, the term of this patent is extended or adjusted under 35 U.S.C. 154(b) by 14 days.

(21) Appl. No.: 14/250,890

(22) Filed: Apr. 11, 2014

(65) Prior Publication Data

US 2014/0326228 A1 Nov. 6, 2014

Related U.S. Application Data

(60) Provisional application No. 61/819,006, filed on May 3, 2013.

(51) Int. Cl.

| | |
|---|---|
| ***F41B 11/00*** | (2013.01) |
| ***F41B 7/08*** | (2006.01) |
| ***F41B 11/642*** | (2013.01) |
| ***F41B 7/00*** | (2006.01) |

(52) U.S. Cl.
CPC . *F41B 7/08* (2013.01); *F41B 7/003* (2013.01); *F41B 11/642* (2013.01); *Y10T 29/49826* (2015.01)

(58) Field of Classification Search
CPC ..... F41B 11/642; F41B 7/08; F41B 7/003; F41B 11/89
USPC ..... 124/16, 27, 40, 66; 446/473
See application file for complete search history.

(56) References Cited

U.S. PATENT DOCUMENTS

| | | | | |
|---|---|---|---|---|
| 961,511 | A | | 6/1910 | Marble |
| 1,374,757 | A | | 4/1921 | Napier |
| 1,441,975 | A | | 1/1923 | Edelin |
| 2,109,589 | A | | 3/1938 | Horwitt et al. |
| 2,375,607 | A | | 5/1945 | Wulfert |
| 2,483,752 | A | | 10/1949 | Buhl |
| 2,501,254 | A | * | 3/1950 | Beaver ..... 42/70.06 |
| 2,725,868 | A | | 12/1955 | Foster |
| 2,762,356 | A | | 9/1956 | Foster |
| 3,302,319 | A | | 2/1967 | Rosselet |
| 3,515,114 | A | * | 6/1970 | Carbonneau ..... 124/27 |
| 3,717,136 | A | * | 2/1973 | Gay, et al. ..... 24/21 |
| 3,765,396 | A | | 10/1973 | Klenholz et al. |
| 3,818,887 | A | * | 6/1974 | Akiyama et al. ..... 124/67 |
| 3,913,553 | A | | 10/1975 | Braughler et al. |
| 3,968,783 | A | * | 7/1976 | Pfotenhauer ..... 124/25 |
| 4,004,566 | A | | 1/1977 | Fischer |
| 4,170,215 | A | | 10/1979 | Kettlestrings |
| 4,248,202 | A | | 2/1981 | Jaworski et al. |
| 4,367,723 | A | | 1/1983 | Resuggan |

(Continued)

*Primary Examiner* — Melba Bumgarner
*Assistant Examiner* — Alexander Niconovich
(74) *Attorney, Agent, or Firm* — Perry Hoffman

(57) ABSTRACT

A toy launch apparatus for discharging circular projectiles of predetermined diameter and height. The apparatus includes multiple safety features to prevent inappropriate objects inserted into the apparatus from enabling the apparatus to operate. A side latch is mounted that locks a shuttle to a housing assembly unless a properly sized projectile is inserted that rotates a side latch bar rotatably mounted to the shuttle out of engagement with an abutment surface in the housing assembly. A top latch is mounted that locks the shuttle to the housing assembly unless the inserted projectile also rotates a top latch bar mounted to the shuttle out of engagement with another abutment surface in the housing assembly.

20 Claims, 15 Drawing Sheets

(56) References Cited

U.S. PATENT DOCUMENTS

| | | | | |
|---|---|---|---|---|
| 4,659,320 | A | 4/1987 | Rich et al. | |
| 4,771,758 | A | 9/1988 | Taylor et al. | |
| 4,834,059 | A * | 5/1989 | Moorhouse et al. | 124/67 |
| 5,113,842 | A | 5/1992 | Moormann | |
| 5,165,383 | A | 11/1992 | Ebert et al. | |
| 5,205,271 | A | 4/1993 | Casas-Salva | |
| 5,267,549 | A | 12/1993 | Webber | |
| 5,292,134 | A | 3/1994 | Schlundt et al. | |
| 5,377,656 | A | 1/1995 | Lewinski et al. | |
| 5,433,646 | A | 7/1995 | Tarng | |
| 5,471,967 | A | 12/1995 | Matsuzaki et al. | |
| 5,515,837 | A * | 5/1996 | Nin et al. | 124/59 |
| 5,517,780 | A * | 5/1996 | Haber et al. | 42/70.08 |
| 5,529,050 | A * | 6/1996 | D'Andrade | 124/56 |
| 5,575,270 | A | 11/1996 | Casas-Salva | |
| 5,605,140 | A | 2/1997 | Griffin | |
| 5,611,322 | A | 3/1997 | Matsuzaki et al. | |
| 5,711,285 | A | 1/1998 | Stewart et al. | |
| 5,996,564 | A | 12/1999 | Kotowski | |
| 6,116,229 | A * | 9/2000 | Wu | 124/6 |
| 6,224,457 | B1 | 5/2001 | Wu | |
| 6,352,070 | B1 * | 3/2002 | Mendoza-Orozco | 124/37 |
| 6,439,216 | B1 * | 8/2002 | Johnson et al. | 124/70 |
| 6,598,329 | B1 | 7/2003 | Alexander | |
| 6,612,298 | B2 * | 9/2003 | Mendoza-Orozco | 124/37 |
| 6,733,356 | B2 | 5/2004 | Lee | |
| 7,051,727 | B2 * | 5/2006 | Wu | 124/6 |
| 7,287,526 | B1 * | 10/2007 | Bligh et al. | 124/63 |
| 7,360,331 | B2 | 4/2008 | McGarry | |
| 7,418,797 | B1 | 9/2008 | Crose | |
| 7,430,825 | B2 * | 10/2008 | Vanek et al. | 42/18 |
| 7,437,847 | B1 | 10/2008 | Mabry | |
| 7,552,557 | B1 | 6/2009 | Mabry | |
| 7,673,624 | B2 * | 3/2010 | Rosella, Jr. | 124/10 |
| 7,938,110 | B2 | 5/2011 | Udwin | |
| 8,082,909 | B2 | 12/2011 | Sopinsky et al. | |
| D658,726 | S | 5/2012 | Greiner | |
| 8,387,605 | B2 * | 3/2013 | Brown et al. | 124/27 |
| 8,567,378 | B2 * | 10/2013 | Nugent | 124/59 |
| 8,720,426 | B2 * | 5/2014 | Hadley et al. | 124/66 |
| 8,875,688 | B2 * | 11/2014 | Nugent | 124/73 |
| 8,875,689 | B2 * | 11/2014 | Chor-Ming | 124/80 |
| 8,875,690 | B2 * | 11/2014 | Chor-Ming | 124/82 |
| 8,997,727 | B1 * | 4/2015 | Hamel et al. | 124/10 |
| 2002/0134366 | A1 * | 9/2002 | Rehkemper et al. | 124/78 |
| 2006/0242880 | A1 | 11/2006 | Griffin | |
| 2007/0034197 | A1 | 2/2007 | Tschech | |
| 2007/0261689 | A1 | 11/2007 | Tai et al. | |
| 2010/0147277 | A1 * | 6/2010 | Zimmerman et al. | 124/56 |
| 2011/0041821 | A1 * | 2/2011 | Brown et al. | 124/27 |
| 2012/0024278 | A1 * | 2/2012 | Carlson et al. | 124/65 |
| 2012/0024279 | A1 * | 2/2012 | Carlson et al. | 124/66 |
| 2012/0073554 | A1 * | 3/2012 | Victor et al. | 124/16 |
| 2012/0125304 | A1 * | 5/2012 | Brooks et al. | 124/52 |
| 2012/0216786 | A1 * | 8/2012 | Hadley et al. | 124/66 |
| 2012/0240912 | A1 * | 9/2012 | Hu | 124/80 |
| 2013/0239936 | A1 * | 9/2013 | Victor et al. | 124/16 |
| 2013/0239938 | A1 * | 9/2013 | Nugent | 124/59 |
| 2013/0239939 | A1 * | 9/2013 | Nugent | 124/73 |
| 2014/0352677 | A1 * | 12/2014 | Chia | 124/66 |

* cited by examiner

TOY LAUNCH APPARATUS WITH SAFETY LATCHES

FIELD OF THE INVENTION

The present invention relates generally to a toy launch apparatus, and, more particularly, to a toy launch apparatus that has several safety features to prevent the insertion or loading of inappropriate objects and to prevent operation of the launch apparatus unless a projectile of predetermined shape is inserted.

BACKGROUND OF THE INVENTION

Toys and other devices that discharge objects have been designed in the past with various housing and internal elements. These devices are designed to discharge specifically design projectiles to eliminate or greatly reduce bodily injury and property damage. To insure that users not succeed in inserting objects that are dangerous and/or destructive better safety features are needed.

Launching devices are well known and are disclosed in several existing patents. By way of example, Gay and others patented a launching device in 1973, U.S. Pat. No. 3,717,136, entitled "Spring Actuated Projector Having Gravity Fed Magazine," which patent purports to disclose a disc having a serrated edge to be impacted by a pivotal arm biased by a rubber band. The arm has a leading serrated edge to engage the disc and cause the disc to spin. The launcher uses a channel having side rails to limit the width of objects that may be inserted, a top wall to limit height of such objects and a bottom trough so that small objects, such as a pencil, fall into the trough and are not able to be impacted by the pivotal arm. In 1983, Resiggam received U.S. Pat. No. 4,367,723, issued for an "Air Gun with Piston Fully Cocked in Plurality of Stages," that purports to disclose a pawl and rack to facilitate partial or full cocking of an air gun.

U.S. Pat. No. 5,165,383 issued in 1992 to Ebert and others for a "Gun with Pivoting Barrel, Projectile Loader, and Trigger Interlock," purports to disclose as a safety feature a BB gun with a barrel that pivots from the front. When latched the barrel is aligned and may be fired, when unlatched the barrel pivots and cannot be fired. A year later, in 1993, U.S. Pat. No. 5,205,271 issued to Casas-Salva for an "Air Rifles of the Hinged Barrel Type," that purports to also disclose an air rifle with a pivoting barrel for cocking a piston/spring and a spring biased catch for holding the barrel in alignment for firing. U.S. Pat. No. 5,575,270 issued in 1996 to Casas-Salva for "Air Guns," which purports to disclose another air gun having a pivoting barrel, two spaced apart arms on the stock, and a tongue on the barrel so that when the barrel is brought into alignment the tongue fits between the arms to ensure proper location.

These patents and devices are of some interest, however, they do not disclose or illustrate a toy item with sufficient safety and play value.

SUMMARY OF THE INVENTION

In accordance with the present invention, an advantageous method and apparatus are provided in the form of a toy launch apparatus that is designed to discharge a soft foam circular projectile. The launcher includes several safety features to prevent unacceptable objects from being inserted into the launcher. First, is the border of the launcher muzzle that limits the size of any object to be loaded. Second is a pair of posts that are spaced apart a predetermined distance and limits the maximum width or diameter of an object that may be inserted. Next are two pivotal bars that are located to limit diameter and height of objects inserted so that if the objects do not meet the width and height requirements the launcher cannot be operated. Regardless of the safety features the launch apparatus is easily operated, even by young children, and requires proper projectile to be inserted, a slide to be moved rearward to cock a launch spring, and a trigger pull to be actuated. The launch apparatus also has the advantages of being relatively simple, easy to operate, fun to use, safe, relatively inexpensive, compact and yet, structurally robust.

Briefly summarized, the invention relates to a toy launch apparatus with multiple safety features including a housing assembly, a first structure for receiving a projectile, the projectile receiving structure being movably mounted in the housing assembly between a first position and a second position, a cocking assembly mounted to the housing assembly, the cocking assembly including a second structure connected to the projectile receiving structure, a launch spring, and a third structure connected to the launch spring, the third structure for engaging an inserted projectile and being movable between a first position and a second position, and the second structure for operation by a user, a trigger assembly mounted to the housing assembly, the trigger assembly being connected to the third structure, a first latch mounted to the projectile receiving structure and to the housing assembly, the first latch being movable between a first position to prevent operation of the cocking assembly when an inserted projectile does not have sufficient width and a second position to enable operation of the cocking assembly, and a second latch mounted to the projectile receiving structure and to the housing assembly, the second latch being movable between a first position to prevent operation of the cocking assembly when an inserted projectile does not have sufficient height and a second position to enable operation of the cocking assembly.

The invention also relates to a method for making the toy launch apparatus with multiple safety features, the steps of the method including forming a housing assembly, mounting a first structure to the housing assembly, the first structure having a projectile receiving opening, and the first structure being movable between non-cocked and cocked positions, mounting a second structure to the housing assembly to cock the first structure, mounting a third structure in the first structure, the third structure movable between non-cocked and cocked positions, mounting a launch spring to the third structure and to the housing assembly, mounting a first latch to the first structure and to a side wall of the housing assembly for preventing movement of the first structure unless an appropriate size projectile is inserted into the first structure, mounting a second latch to the first structure and to a top wall of the housing assembly for preventing movement of the first structure unless an appropriate size projectile is inserted into the first structure, and mounting a trigger assembly to the housing assembly to release the third structure from a cocked position.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENT

The following description is provided to enable those skilled in the art to make and use the described embodiment set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
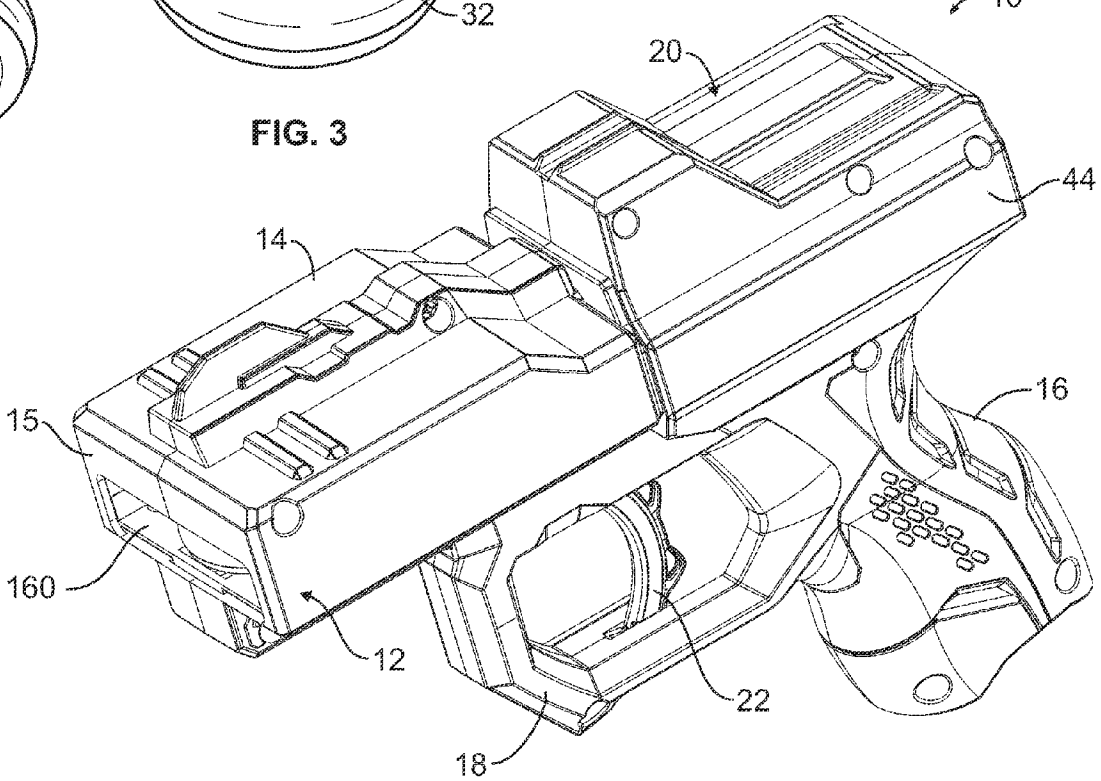
FIG. 1 is a downward looking isometric view of a preferred embodiment of the present invention in the form of a toy launch apparatus.
Figure 3:
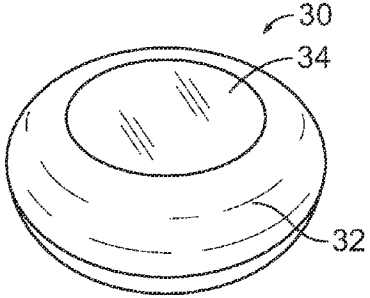
FIG. 3 is a downward looking isometric view of the disc projectile shown in FIG. 2.
Figure 2:
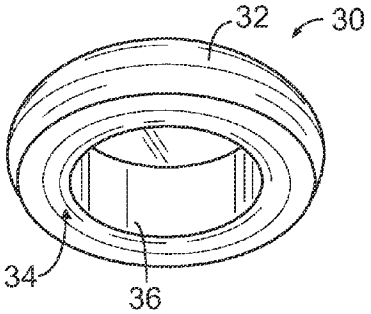
FIG. 2 is an upward looking isometric view of a disc projectile, an acceptable projectile for the launch apparatus shown in FIG. 1.

Referring now to FIG. 1, there is shown an embodiment of the invention in the form of a toy launch apparatus 10 having a housing assembly 12 including a barrel portion 14, a muzzle portion 15, a grip portion 16 and a trigger guard portion 18. A cocking assembly 20 is mounted to the housing assembly 12, as is a trigger assembly 22. The launch apparatus 10 is constructed for discharging a circular projectile of predetermined dimensions, and has safety features to prevent other objects from being inserted and discharged. One such acceptable projectile is a disc 30, FIGS. 2 and 3, having an outer covering 32 of soft foam material, such as that sold under the brand NERF®, and an inner core 34 of a more robust material, such as a hard plastic, all as disclosed in a companion patent application (U.S. application Ser. No. 12/890,686). The outer covering 32 is generally donut shaped with an open center and the inner core 34 is generally cup shaped (inverted) and positioned in the open center so that the top of the projectile is closed, as shown in FIG. 3, and the bottom is opened, as shown in FIG. 2. Bordering the open bottom is an annular inner wall 36 of the inner core 34. The soft exterior of the disc 30 prevents or minimizes injury to users and playmates as well as to furniture and wall surfaces.

Figure 4:
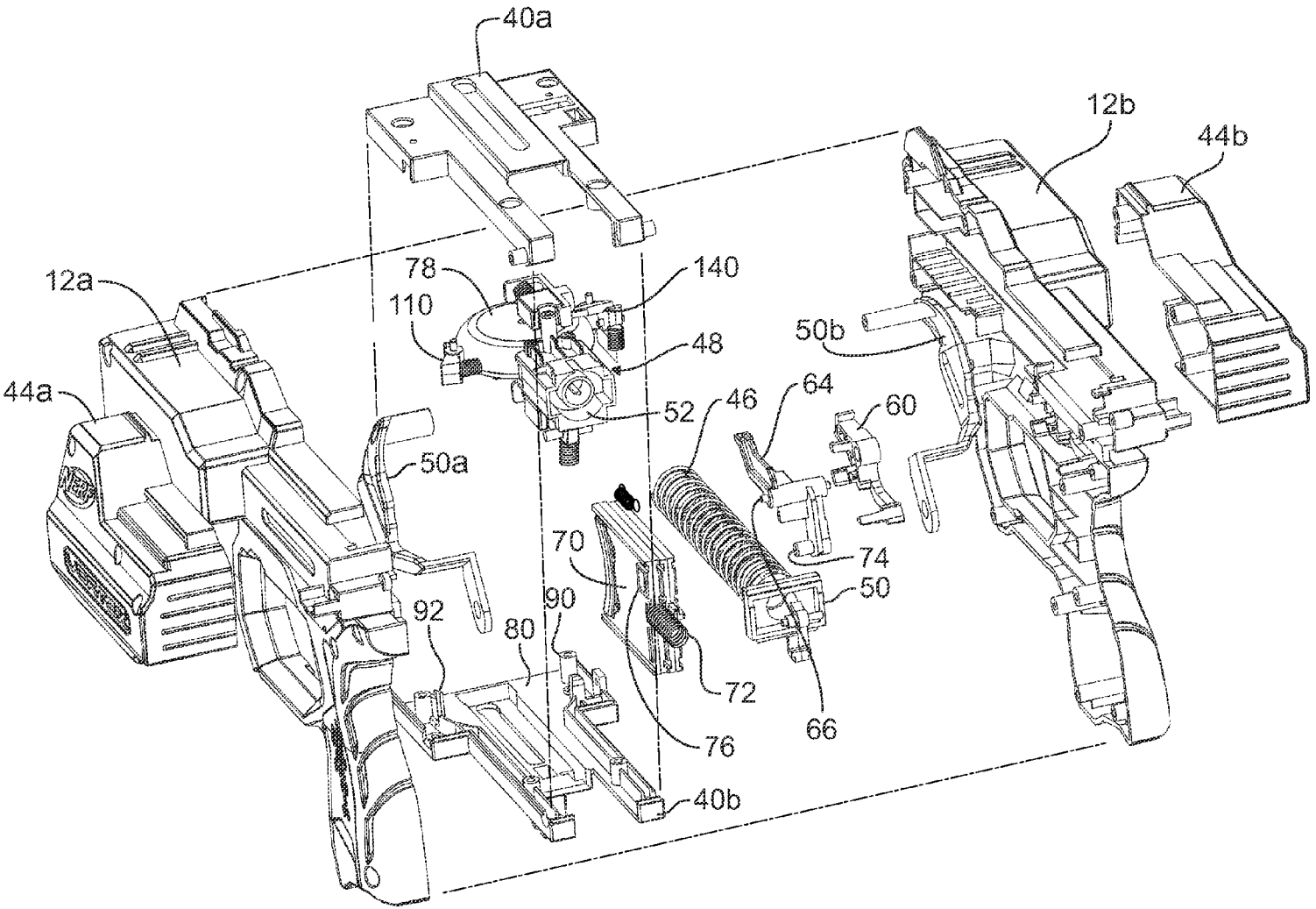
FIG. 4 is an exploded rear isometric view of the launch apparatus shown in FIG. 1.
Figure 9:
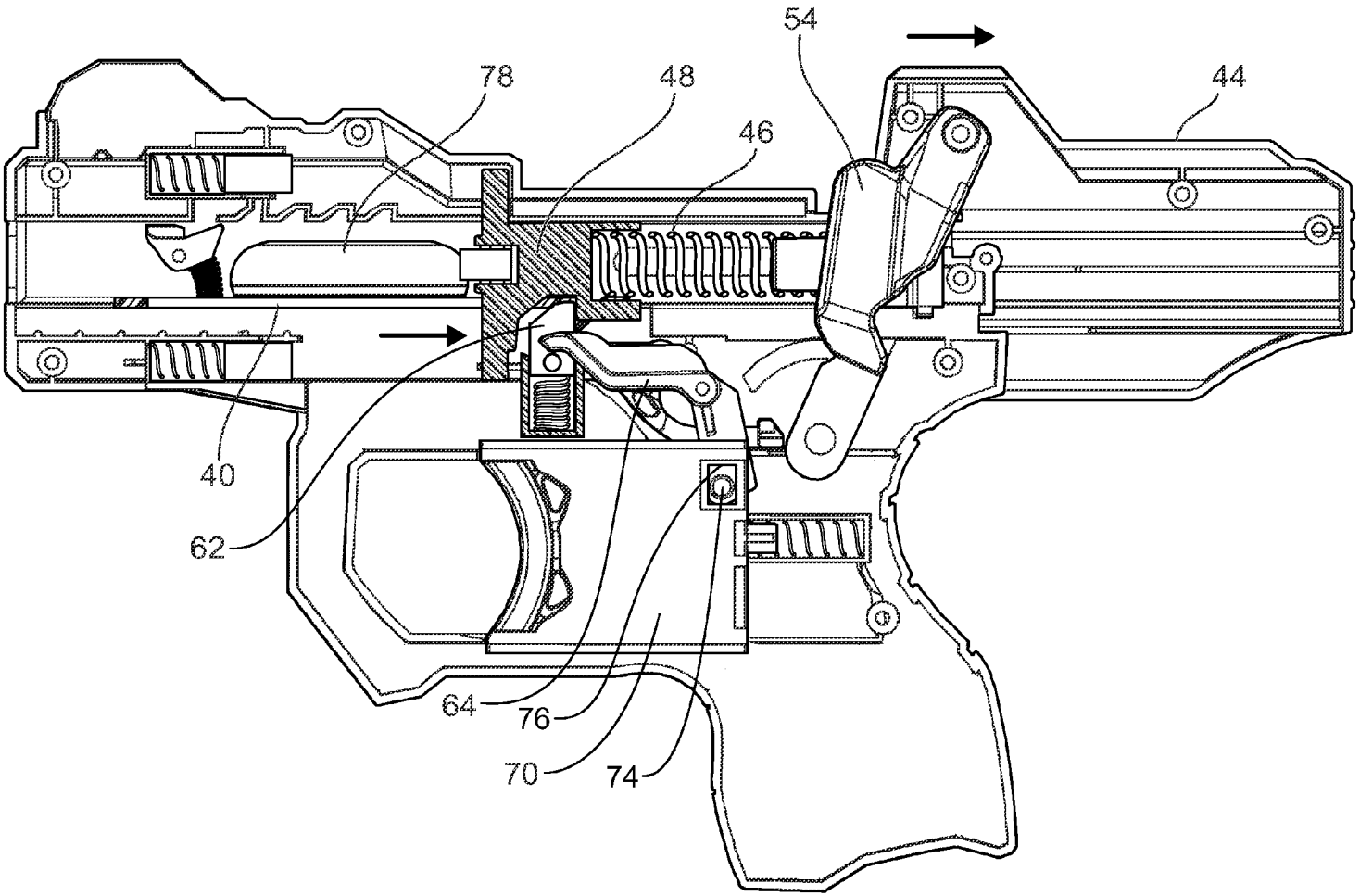
FIG. 9 is a side elevation view, partially in section, of the launch apparatus shown in FIG. 7, but during a cocking phase.
Figure 10:
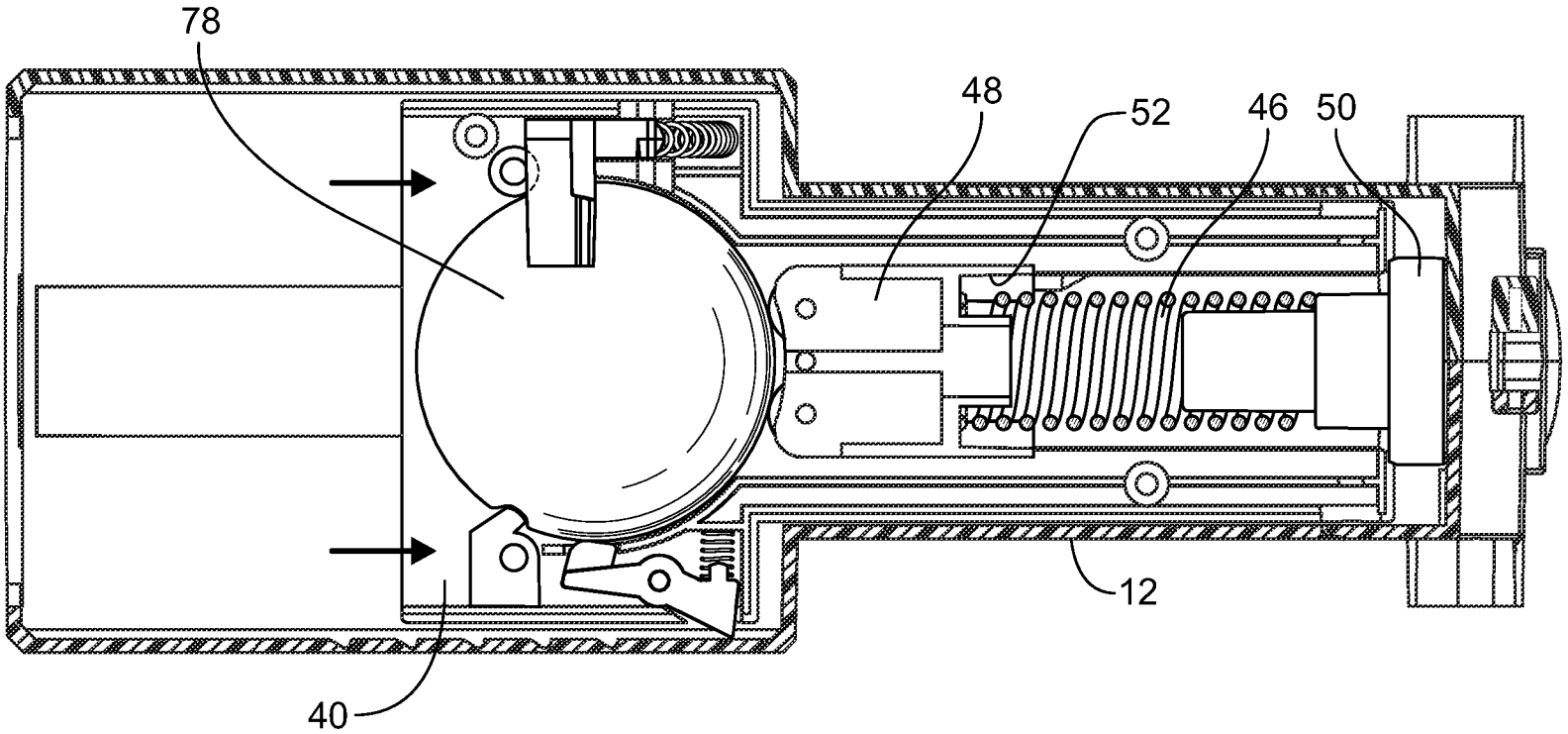
FIG. 10 is a top plan view, partially in section, of the launch apparatus shown in FIG. 9.

The housing assembly 12 may be molded in two parts, a left housing part 12*a*, FIG. 4, and a right housing part 12*b*. A first structure or shuttle 40 is mounted to the housing assembly 12 to slide between a forward, non-cocked position shown in FIG. 5, and a rearward, cocked position shown in FIG. 10, and may also be molded in two parts, an upper shuttle part 40*a*, FIG. 4, and a lower shuttle part 40*b*. The cocking assembly 20 includes a second structure or slide 44 that may be molded in two parts, a left slide part 44*a* and a right slide part 44*b*. The cocking assembly also includes a launch spring 46, and a third structure or ram 48. The ram 48 is mounted in the shuttle 40 to also move between a forward, non-cocked position shown in FIG. 5, and a rearward, cocked position shown in FIG. 10. The slide 44 moves between two positions, a forward non-cocked position shown in FIGS. 6 and 8, and a rearward cocked position shown in FIG. 9. The launch spring 46 is mounted between a rear spring seat 50, FIG. 4, fixed to the housing assembly 12 and a front spring seat 52 formed as part of the ram 48. The launch spring 46 moves between an extended, generally relaxed, position shown in FIGS. 5-8, and a compressed cocked position shown in FIGS. 9 and 10.

Figure 8:
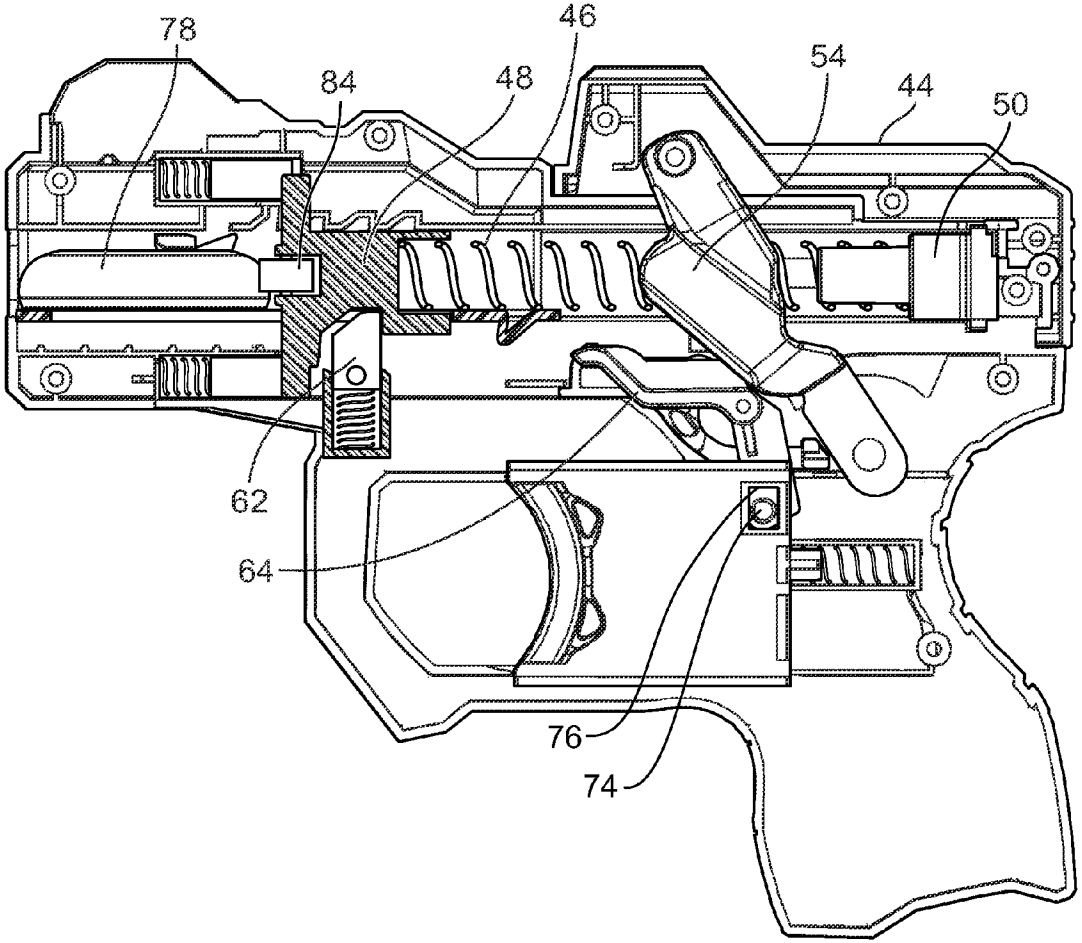
FIG. 8 is a side elevation section view, partially in section, of the launch apparatus shown in FIG. 7.
Figure 11:
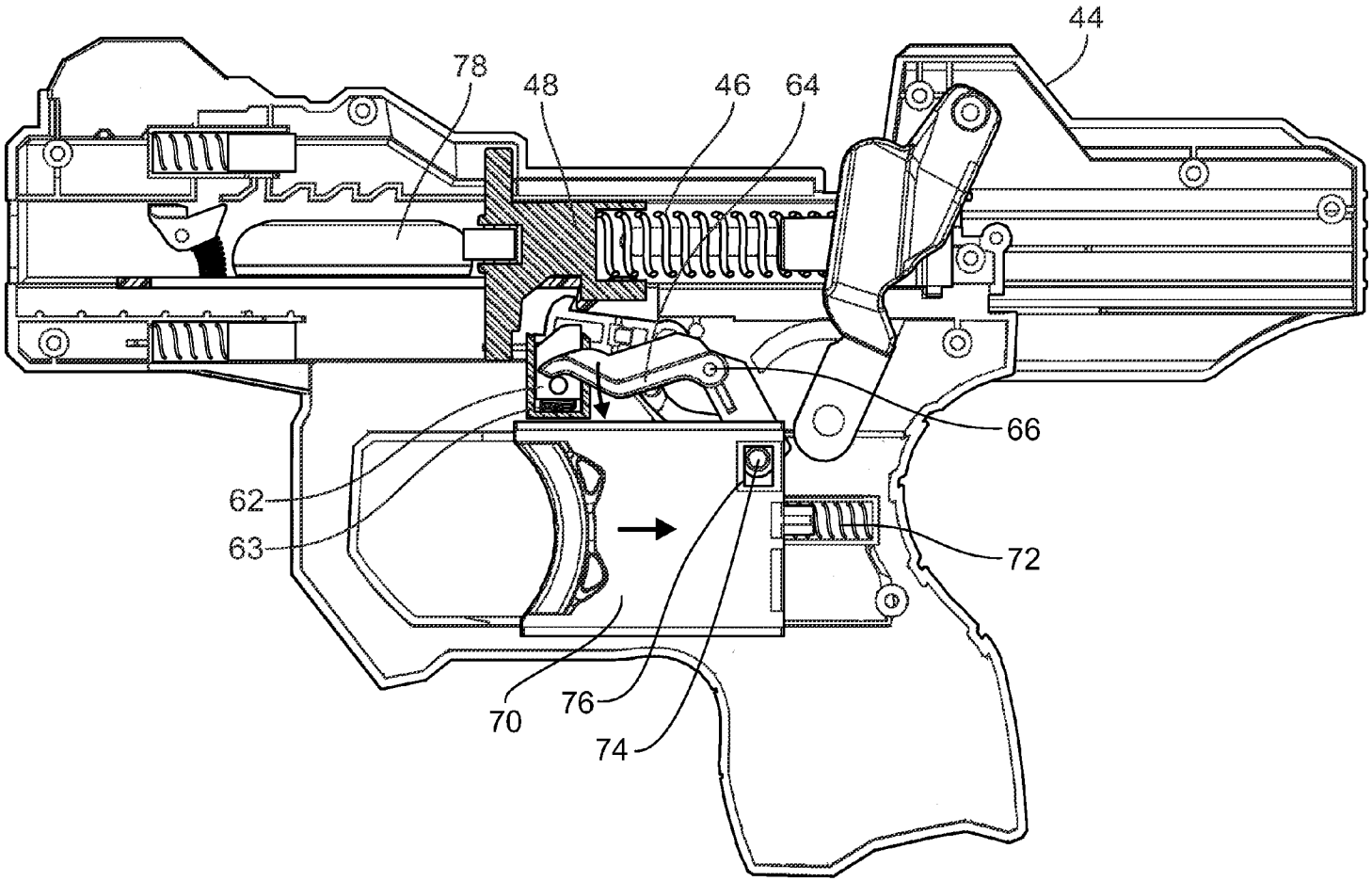
FIG. 11 is a side elevation view, partially in section, of the launch apparatus shown in FIG. 9, in a cocked configuration and after a trigger pull is operated.
Figure 12:
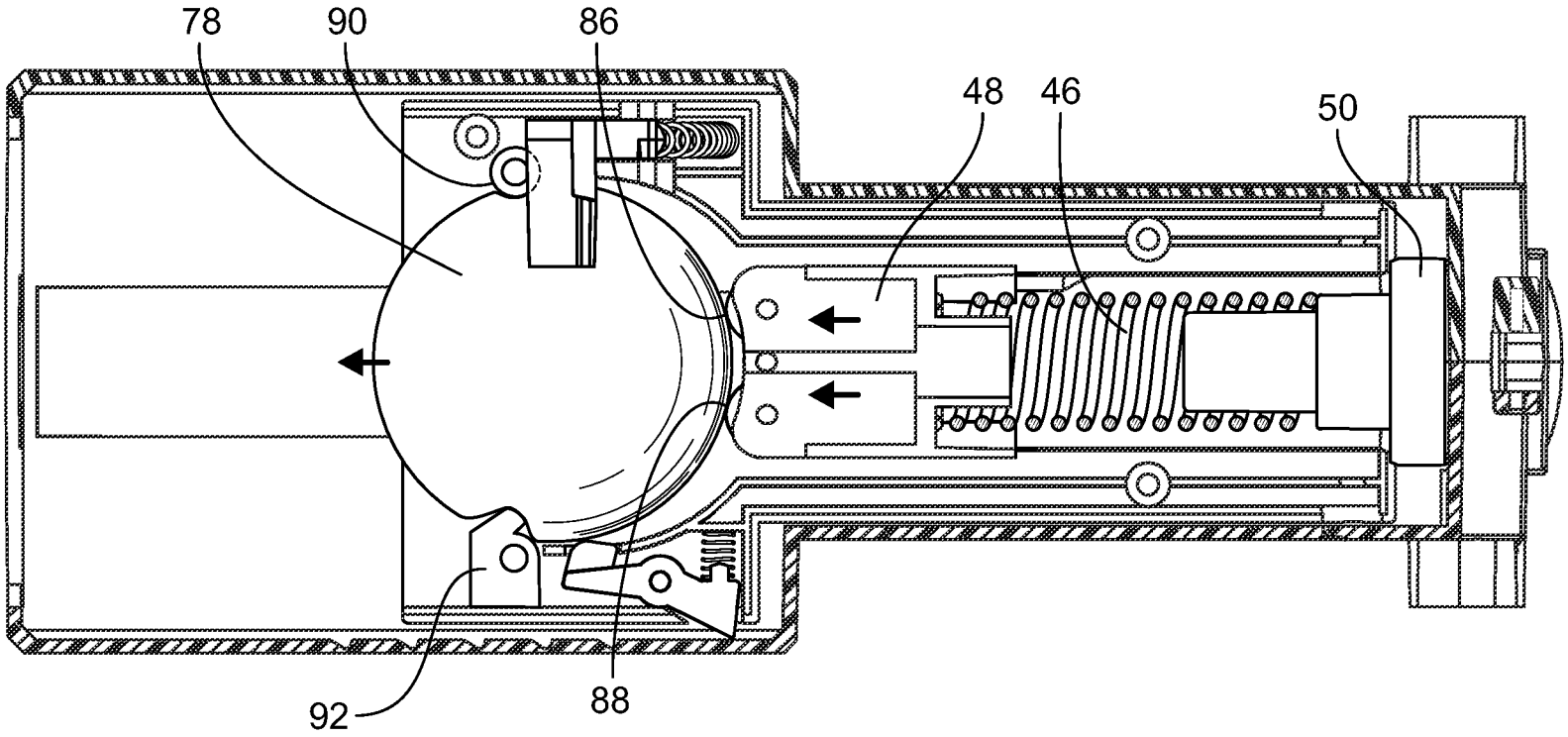
FIG. 12 is a top plan view, partially in section, of the launch apparatus illustrating the start of a discharge phase.
Figure 13:
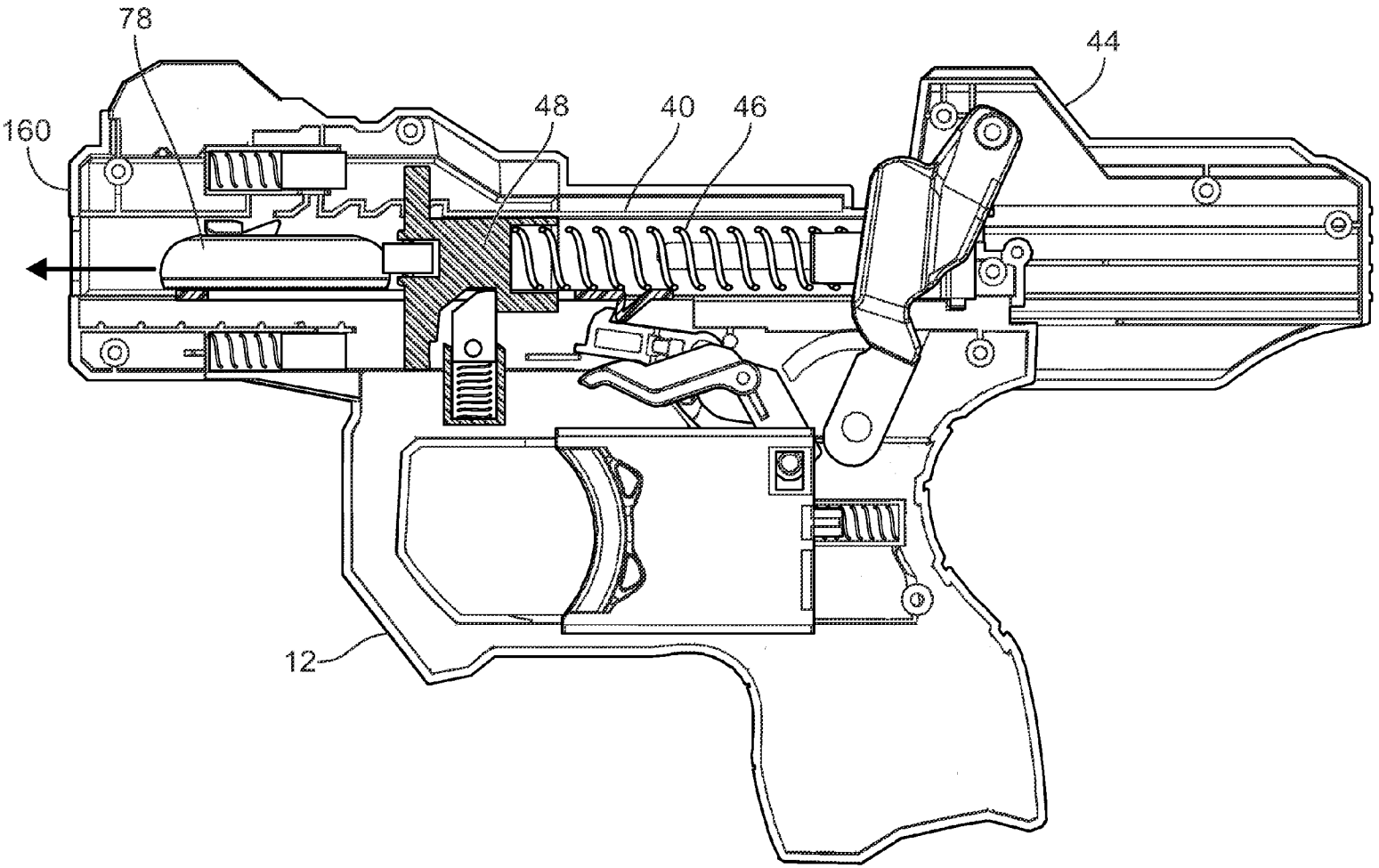
FIG. 13 is a side elevation view, partially in section, of the launch apparatus illustrating a ram driving a projectile forward toward a muzzle of the launch apparatus.
Figure 14:
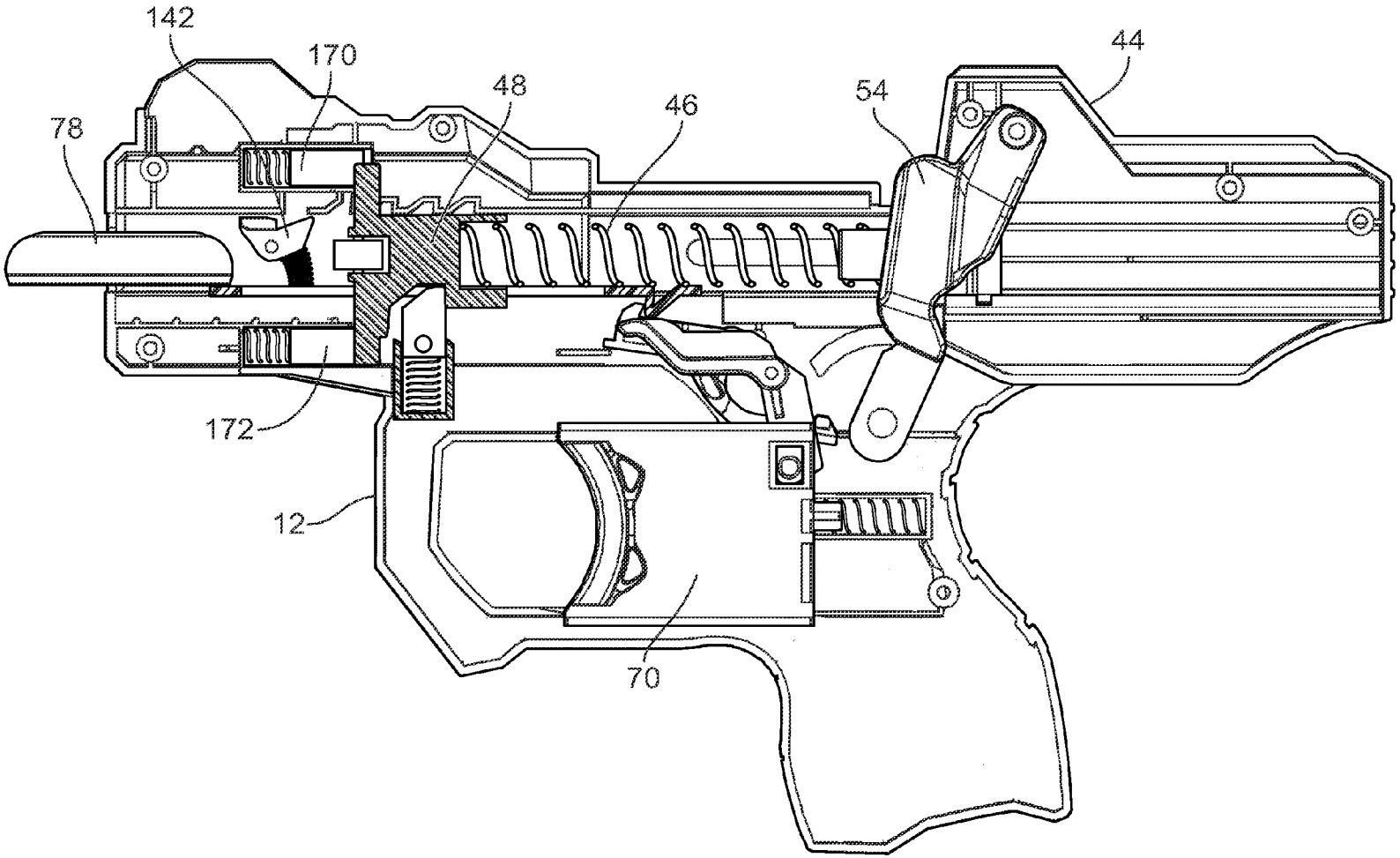
FIG. 14 is a side elevation view, partially in section, of the launch apparatus shown in FIG. 13, illustrating the ram at a fully forward position and the projectile leaving the muzzle of the launch apparatus.
Figure 15:
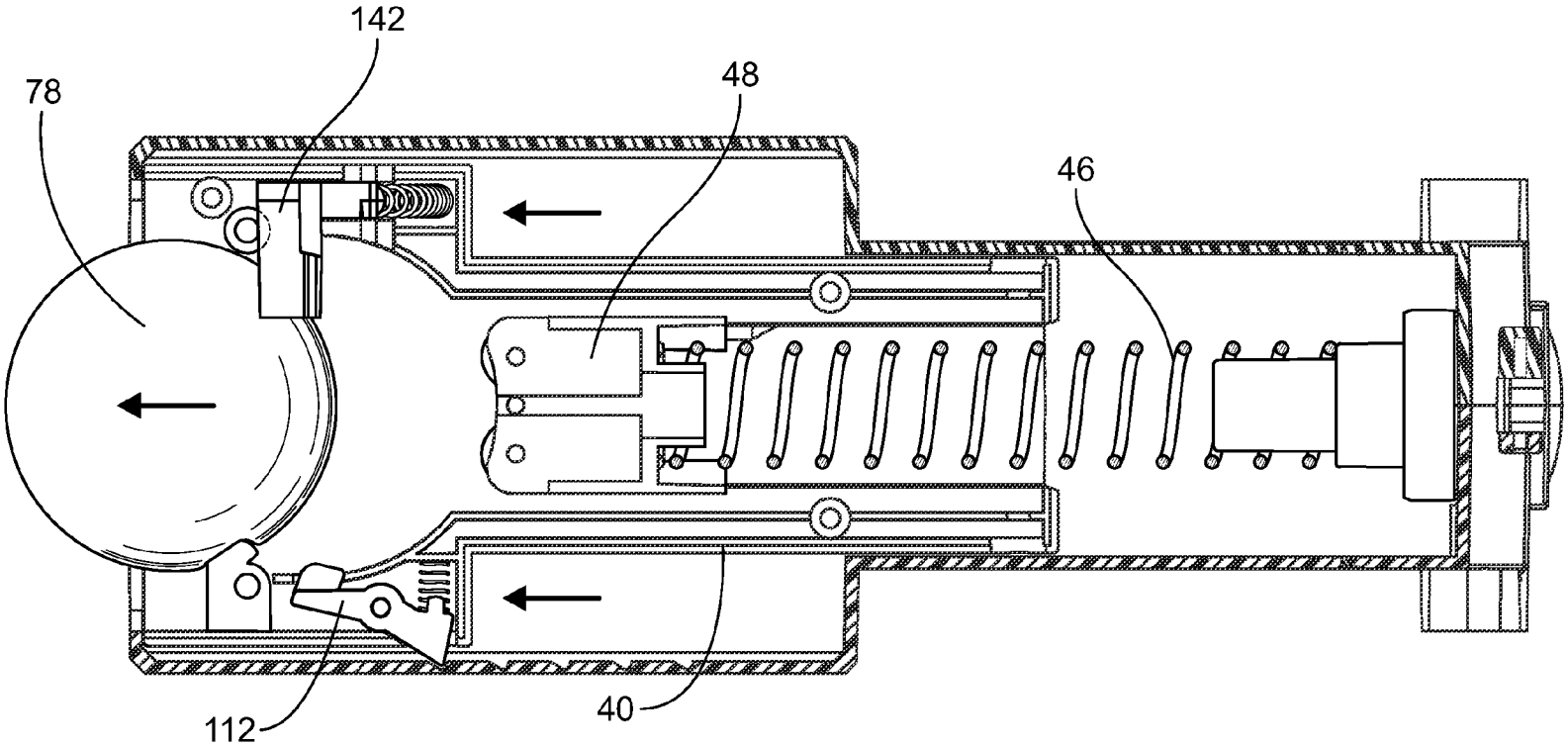
FIG. 15 is a top plan view, partially in section, of the launch apparatus shown in FIG. 14.

The cocking assembly 20 also includes a slide link 54, FIGS. 4 and 8 that may be formed in two parts, a left slide link part 54*a*, FIG. 4, and a right slide link part 54*b*. The slide link 54 is connected to the slide 44 and pivots as a user manipulates the slide 44. Connected to the slide link 54 is a shuttle link 60 for moving the shuttle 40 between the forward, non-cocked position and the rearward, cocked position. A ram latch pin 62, biased by a spring 63 is used for restraining the ram 48 until released. A ram release bar 64 is connected to pivot about a shaft 66, FIG. 11. The trigger assembly 22 includes a trigger pull 70 and a trigger pull biasing spring 72. An endpin 74, FIGS. 8, 9 and 11, of the ram release bar 64 is mounted in a slot 76 in the trigger pull 70 so that when the trigger pull is drawn rearward, the ram release bar 64 rotates counterclockwise to depress the ram latch pin 62. When the ram release bar 64 pivots, the ram 48 and the launch spring 46 are released as shown in FIGS. 11 and 12, and the ram 48 rushes the projectile 78 out of the launch apparatus as shown in FIGS. 13-15 during a discharge phase of the launcher.

Figure 5:
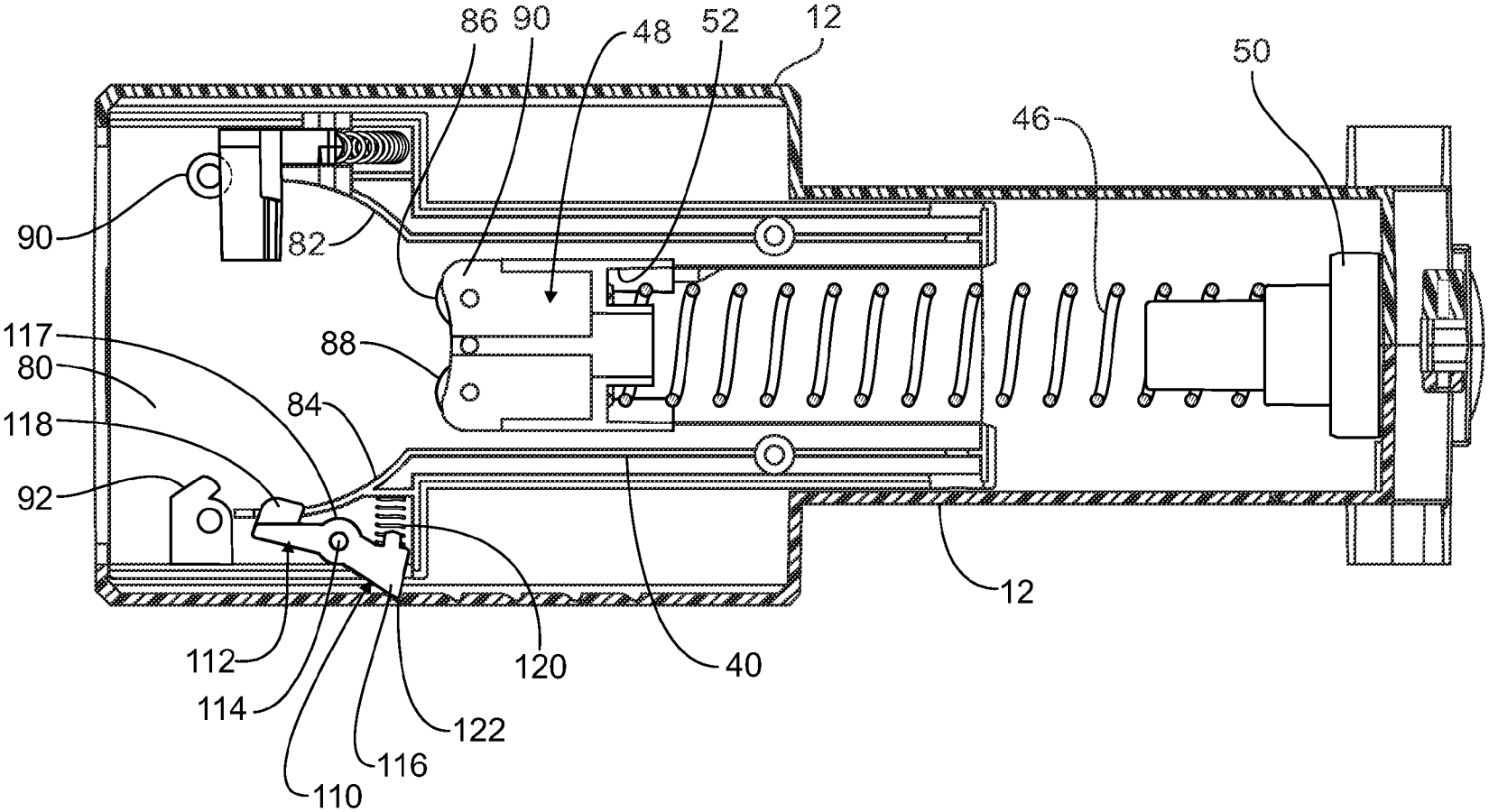
FIG. 5 is a top plan view, partially in section, of the launch apparatus shown in FIGS. 1 and 4, without a projectile.
Figure 7:
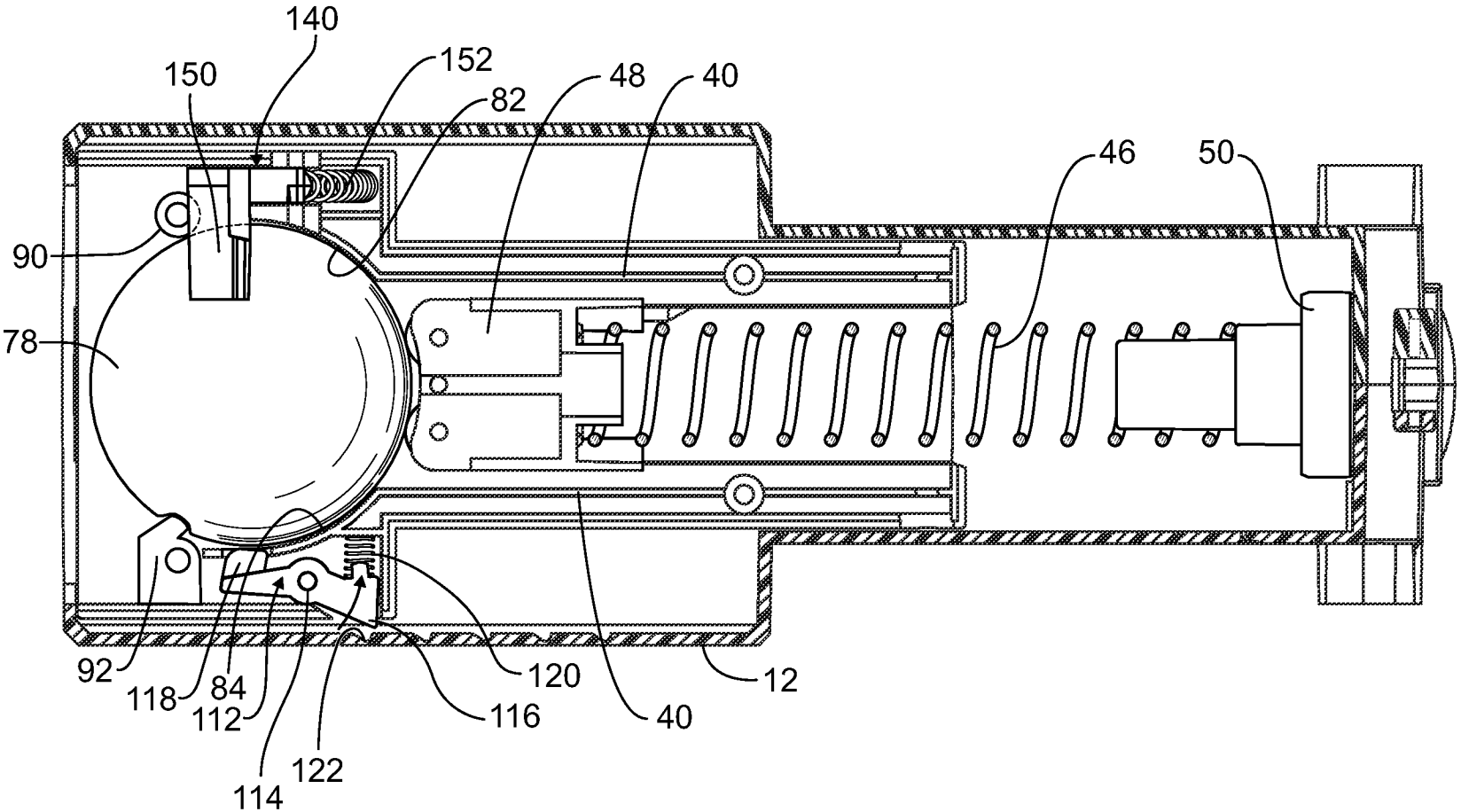
FIG. 7 is a top plan view, partially in section, of the launch apparatus shown in FIG. 5, with a loaded projectile.

A launch deck 80, FIGS. 4 and 5, is formed on the lower shuttle 40*b* for receiving and supporting an acceptable or appropriate projectile, one that meets diameter and height parameters, such as the discs 30, 78. The launch deck includes two guide flanges 82, 84 for locating an inserted projectile. The ram 48, FIG. 5, includes two rollers 86, 88 mounted to a forward portion 90 of the ram for allowing the projectile to initiate spin during discharge. In a cocking phase of the launch apparatus 10, the slide 44 may be gripped by a user and pulled rearward. Mounted to the launch deck are two projections or posts 90, 92, FIGS. 4, 5 and 7. The posts are spaced from one another by a distance just short of the diameter of an appropriate projectile. The first or upper post 90, as viewed in FIGS. 5 and 7, is cylindrical, may be rotatable, and allows for easy passage of an acceptable projectile, such as the disc 78. The second or lower post 92 extends inward to engage the projectile 78 and cause the projectile to compress slightly when passing between the two posts 90, 92. The soft exterior material of the projectile allows a slight squeeze or deformation. But if a hard object of larger or the same diameter as the disc 78 is attempted to be inserted, the posts will not yield and the launch apparatus 10 will not receive the object. The second post 92 also provides a frictional pull or drag on a discharging projectile to cause the projectile to spin as shown in FIG. 12.

Projectiles for the launch apparatus 10 are muzzle loaded and offer the possibility that other objects, not appropriate or acceptable, may also be inserted. Inappropriate projectiles or other objects may cause harm if discharged with the energy typically exhibited by spring operated launch apparatus. To prevent inappropriate and/or dangerous objects from being discharged, two safety features are provided that either prevent insertion of the inappropriate and/or dangerous object or fail to unlock the launch apparatus because the object does not conform to the proper projectile size requirements.

A first primary safety feature to preclude the insertion or loading of an inappropriate and/or dangerous object is found in the form of a first or side latch 110, FIG. 5. The side latch includes a pivotal side bar 112 mounted to the shuttle 40 by a pivot shaft 114. The side bar 112 includes a nose portion 116 at one end, a middle pivot portion 117 and an arm portion 118 at an opposite end. The side bar 112 is biased by a first latch spring 120 to engage a first abutment surface, such as a notch 122 of a rack, formed in the housing assembly 12. The engagement of the nose portion 116 and the notch 122 locks the shuttle 40 and prevents movement of the shuttle relative to the housing assembly 12 so as to prevent operation of the launch apparatus. Therefore, the user cannot cock the slide 44 and allow the launch apparatus to discharge anything unless the nose portion 116 is disengaged from the first notch 122. However, when an acceptable projectile, such as the disc 78, which is identical to the disc 30, FIGS. 2 and 3, is loaded, the projectile, having the correct diameter or width will pass both the two posts 90, 92 and the side latch 110. When the disc abuts two guide flanges 82, 84 formed in the shuttle 40, the arm portion 118 of the side bar 112 is moved counterclockwise around the shaft 114 by the disc. Rotation of the arm portion pivots the nose portion 116 against the first latch spring 120 and disengages the nose portion from the first notch 122 in the housing assembly as shown in FIG. 7.

Figure 6:
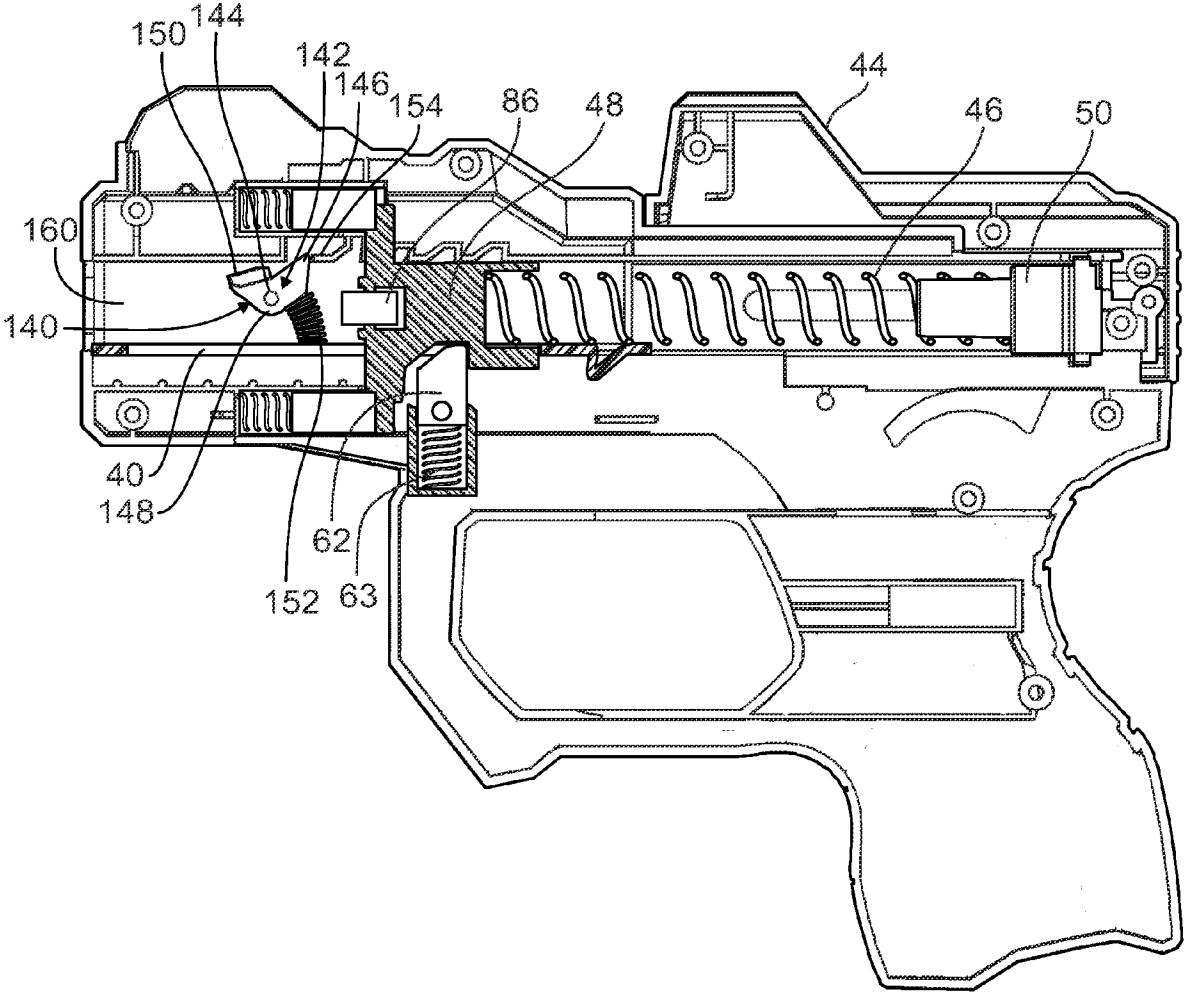
FIG. 6 is a side elevation view, partially in section, of the launch apparatus shown in FIG. 5, with some internal elements removed for clarity.

A second primary safety feature is found in the form of a second or top latch 140, FIG. 6, mounted to the shuttle 40. The top latch 140 includes a pivotal top bar 142 mounted to the shuttle 40 by a pivot shaft 144. The top bar 142 includes a nose portion 146 at one end, a middle pivot portion 148, and an arm portion 150 at an opposite end. The top bar 142 is biased by a second latch spring 152 to engage a second abutment surface 154 formed in the housing assembly 12. The engagement of the nose portion 146 and the second notch 154 also locks the shuttle 40 and prevents movement of the shuttle 40 relative to the housing assembly 12 so as to prevent operation of the launch apparatus. However, when a properly sized projectile is inserted and bears against the two guide rails 82, 84 the projectile, if of the correct height, will bear against the arm portion 150 of the top bar 142 and pivot the top bar to compress the second latch spring 152. This moves the nose portion 146 out of engagement with the second abutment surface 154 as shown in FIGS. 7 and 8, to unlock the shuttle.

It is now apparent that safety features prevent an object that is too big from entering a projectile channel 160, FIGS. 1 and 6, or from passing between the two posts 90, 92. An object too hard, even if the object is of the correct diameter, will not be able to pass the two posts. An object with a small diameter, when adjacent to the guide flanges, will not be wide enough to open the side latch 110. An object too tall will not be able to enter the channel 160 or to pass by the top latch 140, and an object too short will not be able to pivot the top bar 142. These safety features and especially the primary safety features including the side and top latches 110, 140 will prevent a great many inappropriate objects from being loaded and discharged and, thus, prevent injury and damage.

Figure 16:
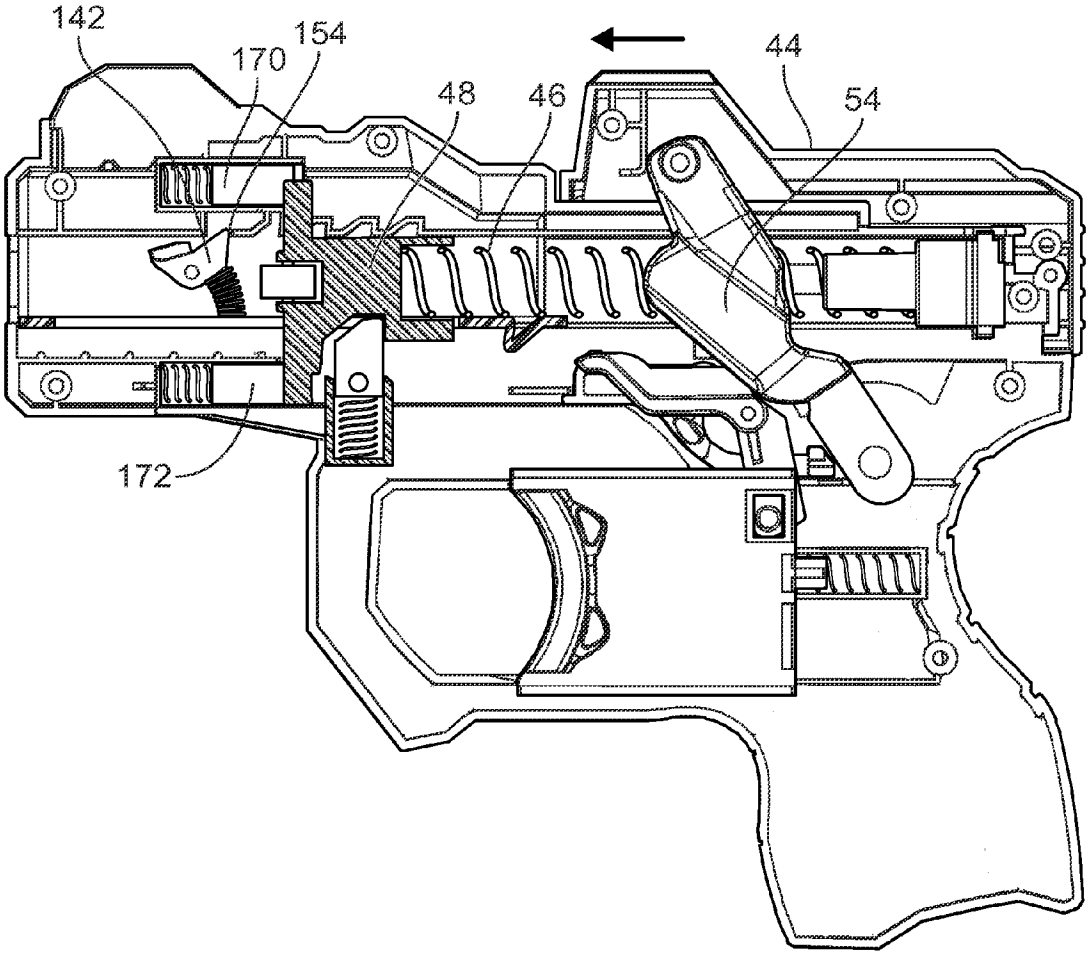
FIG. 16 is a side elevation view, partially in section, of the launch apparatus shown in FIG. 14, illustrating a slide returning to a forward position.

In operation, a user inserts an appropriate projectile, such as the disc 30 shown in FIGS. 2 and 3 or the disc 78, past the two posts 90, 92 so as to pivot the side and top bars 112, 142. When the side and top bars 112, 142 disengage from their respective abutment surfaces 122, 154, FIGS. 7 and 8, the slide 44 is free to be moved rearward (to the right in the figures) when the user cocks the launch apparatus. The motion of the slide 44 is transmitted by the slide link 50, FIGS. 9 and 10, to the shuttle link 60 and from the shuttle link to the shuttle 40 to move the shuttle, the ram 48 and the projectile 78 rearward in the launch apparatus, and to compress and store energy in the launch spring 46. When the user pulls the trigger pull 70, FIG. 11, the trigger pull pivots the ram release bar 64 to depress the ram latch pin 62 and release the ram 48 and cause the projectile 78 to move rapidly forward toward discharge. As illustrated in FIG. 12, the ram and projectile are beginning to move forward, to the left in the drawing view, toward discharge. As illustrated in FIG. 13, the projectile is approaching the muzzle 160 of the launch apparatus and the ram is almost back to its forward position. As illustrated in FIGS. 14 and 15, upper and lower bumpers 170, 172 stop the ram, but the projectile 78 continues out of the launch apparatus. The user then returns the slide 44 to its forward position as shown in FIG. 16. Once the projectile passes the muzzle and the slide is returned forward, the side and top bars 112, 142 pivot to engage the housing assembly and prevent operation of the launch apparatus until an acceptable projectile is inserted.

The launch apparatus may now be loaded with another projectile. If an inappropriate projectile has been pushed into the muzzle, the side and top latches will not open unless the diameter or width and the height dimensions of the projectile are identical or nearly identical with the discs 30, 78. Common household item, such as pencils, pens, paper clips, and garden stones, will not cause the latches to open so that the launch apparatus will not function.

It is noted that throughout this disclosure, words such as "forward", "rearward", "upper", "lower", "top", "bottom", "front", "rear", "above" and "below", as well as like terms, refer to portions of the toy launch apparatus as they are viewed in the drawings relative to other portions or in relationship to the positions of the apparatus as it will typically be held and moved during play when operated by a user.

Figure 17:
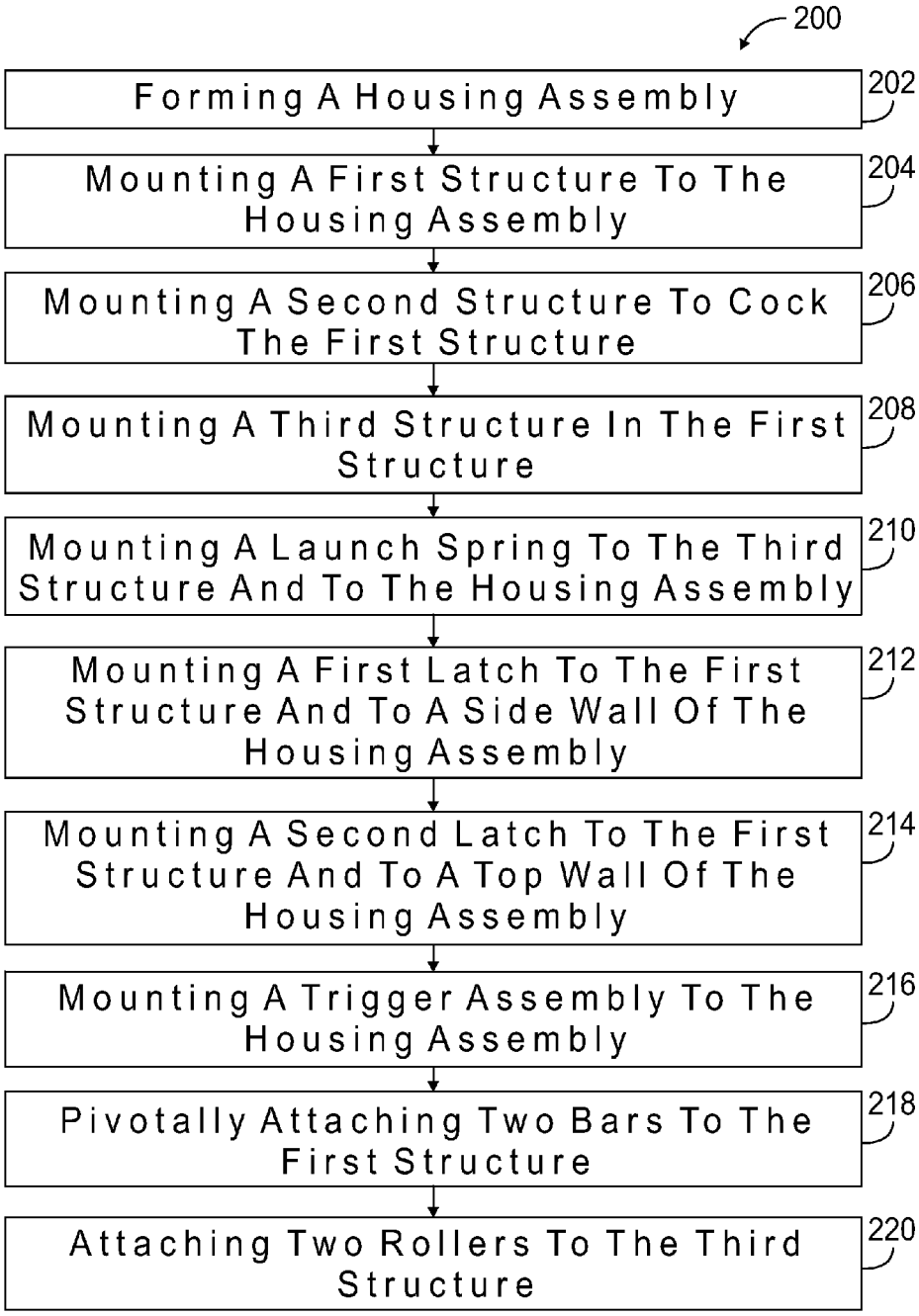
FIG. 17 is a flow diagram of a method for manufacturing the launch apparatus illustrated in FIGS. 1 and 4-16.

The present invention also includes a method 200, FIG. 17, for manufacturing a toy launch apparatus with multiple safety features, the steps of the method including forming a housing assembly 202, mounting a first structure to the housing assembly 204, such as the shuttle 40, the first structure having a projectile receiving opening, and the first structure being movable between non-cocked and cocked positions, mounting a second structure to cock the first structure 206, such as the slide 44, the slide link 54, and the shuttle link 60 mounting a third structure in the first structure 208, such as the ram 48, the third structure being movable between non-cocked and cocked positions, mounting a launch spring to the third structure and to the housing assembly 210, mounting a first latch to the first structure and to a side wall of the housing assembly 212, such as the latch 110, for preventing movement of the first structure unless an appropriate size projectile is inserted into the first structure, mounting a second latch to the first structure and to a top wall of the housing assembly 214, such as the latch 140, for preventing movement of the first structure unless an appropriate sized projectile is inserted into the first structure, and mounting a trigger assembly to the housing assembly 216, such as the trigger assembly 22, to release the third structure from a cocked position. The method may also include the steps of pivotally attaching two bars to the first structure 218, such as the side and top bars 112, 142, and attaching two rollers to the third structure 220, such as the rollers 86, 88.

The toy launch apparatus disclosed in detail above has great play value, is fun to use and easy to operate, and is safe, even for young children, and yet the launch apparatus has a robust, but simple structure, that may be produced at a reasonable cost.

From the foregoing, it can be seen that there has been provided features for an improved toy launch apparatus and a disclosure of the method for making the toy. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launch apparatus with multiple safety features comprising:

a housing assembly;

a first structure for receiving a projectile, the projectile receiving structure being movably mounted in the housing assembly between a first position and a second position;

a cocking assembly mounted to the housing assembly, the cocking assembly including a second structure connected to the projectile receiving structure, a launch spring and a third structure connected to the launch spring, the third structure for engaging an inserted projectile and being movable between a first position and a second position, and the second structure for operation by a user;

a trigger assembly mounted to the housing assembly, the trigger assembly being connected to the third structure;

a first latch mounted to the projectile receiving structure and to the housing assembly, the first latch being movable between a first position to prevent operation of the cocking assembly when an inserted projectile does not have sufficient width and a second position to enable operation of the cocking assembly; and a second latch mounted to the projectile receiving structure and to the housing assembly, the second latch being movable between a first position to prevent operation of the cocking assembly when an inserted projectile does not have sufficient height and a second position to enable operation of the cocking assembly.

2. The toy launch apparatus of claim 1, wherein:

the first latch includes a first pivotal bar mounted to the projectile receiving structure and a first abutment surface mounted to the housing assembly.

3. The toy launch apparatus of claim 2, wherein:

the first pivotal bar includes a nose portion and an arm portion.

4. The toy launch apparatus of claim 3, wherein:

the nose portion of the first pivotal bar selectively engages the first abutment surface and the arm portion of the first pivotal bar selectively engages a projectile inserted in the projectile receiving structure.

5. The toy launch apparatus of claim 1, wherein:

the second latch includes a second pivot bar mounted to the projectile receiving structure and an second abutment surface mounted to the housing assembly.

6. The toy launch apparatus of claim 5, wherein:

the second pivotal bar includes a nose portion and an arm portion.

7. The toy launch apparatus of claim 6, wherein:

the nose portion of the second pivotal bar selectively engages the second abutment surface and the arm portion of the second pivotal bar selectively engages a projectile inserted in the projectile receiving structure.

8. The toy launch apparatus of claim 7, wherein:

the first latch includes a first pivotal bar mounted to the projectile receiving structure and a first abutment surface mounted to the housing assembly.

9. The toy launch apparatus of claim 8, wherein:

the first pivotal bar includes a nose portion and an arm portion.

10. The toy launch apparatus of claim 9, wherein:

the nose portion of the first pivotal bar selectively engages the first abutment surface and the arm portion of the first pivotal bar selectively engages a projectile inserted in the projectile receiving structure.

11. The toy launch apparatus of claim 10, including:

a restraint for engaging the third structure.

12. The toy launch apparatus of claim 10, wherein:

the second structure causes movement of the first structure and the third structure.

13. The toy launch apparatus of claim 12, including:

a restraint for engaging the third structure.

14. A toy launch apparatus with multiple safety features comprising:

a housing assembly;

a shuttle structure for receiving a projectile, the shuttle structure being movably mounted in the housing assembly between a relaxed position and a cocked position;

a cocking assembly mounted to the housing assembly, the cocking assembly including a user operated slide structure connected to the shuttle structure, a launch spring and a ram structure, the ram structure connected to the launch spring for engaging an inserted projectile and the ram structure being movable between a non-cocked position and a cocked position;

a trigger assembly mounted to the housing assembly, the trigger assembly being connected to the ram structure;

a first latch mounted to the shuttle structure and to the housing assembly, the first latch movable between a first position to prevent operation of the cocking assembly when an inserted projectile does not have sufficient width and a second position to enable operation of the cocking assembly; and a second latch mounted to the projectile receiving structure and to the housing assembly, the second latch movable between a first position to prevent operation of the cocking assembly when an inserted projectile does not have sufficient height and a second position to enable operation of the cocking assembly.

15. The toy launch apparatus of claim 14 wherein:

the first latch includes a first pivotal bar mounted to the shuttle structure and a first abutment surface mounted to the housing assembly; and the second latch includes a second pivot bar mounted to the shuttle structure and an second abutment surface mounted to the housing assembly.

16. The toy launch apparatus of claim 15 wherein:

the first pivotal bar includes a nose portion and an arm portion; and the second pivotal bar includes a nose portion and an arm portion.

17. The toy launch apparatus of claim 16 wherein:

the nose portion of the first pivotal bar selectively engages the first abutment surface and the arm portion of the first pivotal bar selectively engages a projectile inserted in the projectile receiving structure; and the nose portion of the second pivotal bar selectively engages the second abutment surface and the arm portion of the second pivotal bar selectively engages a projectile inserted in the projectile receiving structure.

18. A method for making a toy launch apparatus with multiple safety features, the steps of the method comprising:

forming a housing assembly;

mounting a first structure to the housing assembly, the first structure having a projectile receiving opening, and the first structure being movable between non-cocked and cocked positions;

mounting a second structure to the housing assembly to cock the first structure;

mounting a third structure in the first structure, the third structure movable between non-cocked and cocked positions;

mounting a launch spring to the third structure and to the housing assembly;

mounting a first latch to the first structure and to a side wall of the housing assembly for preventing movement of the first structure unless an appropriate size projectile is inserted into the first structure;

mounting a second latch to the first structure and to a top wall of the housing assembly for preventing movement of the first structure unless an appropriate size projectile is inserted into the first structure; and mounting a trigger assembly to the housing assembly to release the third structure from a cocked position.

19. The method of claim 18, wherein the steps of mounting the first and second latches include the step of:

pivotally attaching two bars to the first structure.

20. The method of claim 19, including the step of:

attaching two rollers to the third structure.

* * * * *